US010762828B1

(12) United States Patent
Ma et al.

(10) Patent No.: US 10,762,828 B1
(45) Date of Patent: Sep. 1, 2020

(54) DISPLAY PANEL AND DISPLAY DEVICE

(71) Applicant: Wuhan Tianma Micro-Electronics Co., Ltd., Wuhan (CN)

(72) Inventors: Yangzhao Ma, Wuhan (CN); Yujiao Liang, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/503,469

(22) Filed: Jul. 4, 2019

(30) Foreign Application Priority Data

Feb. 28, 2019 (CN) ..... 2019 1 0152306

(51) Int. Cl.
*G09G 3/20* (2006.01)

(52) U.S. Cl.
CPC ... *G09G 3/2092* (2013.01); *G09G 2300/0408* (2013.01); *G09G 2300/0426* (2013.01); *G09G 2300/0439* (2013.01); *G09G 2310/0286* (2013.01)

(58) Field of Classification Search
CPC ..... G09G 3/2092; G09G 2310/0286; G09G 2300/0408; G09G 2300/0439; G09G 2300/0426
See application file for complete search history.

(56) References Cited

U.S. PATENT DOCUMENTS 10,559,597 B1 * 2/2020 Li ..... H01L 27/1255
2014/0241487 A1 * 8/2014 Yamazaki ..... G11C 19/28 377/54
2017/0061918 A1 * 3/2017 Lim ..... G02F 1/1345
2018/0219987 A1 * 8/2018 Pantel ..... G06F 1/1637
2019/0036073 A1 * 1/2019 Yu ..... H01L 51/5281
2019/0051718 A1 * 2/2019 Zhang ..... H01L 27/3276
2019/0109184 A1 * 4/2019 Li ..... H01L 27/3248
2019/0304359 A1 * 10/2019 Liu ..... G09G 3/3225
2020/0135832 A1 * 4/2020 Ma ..... H01L 27/14812
2020/0168141 A1 * 5/2020 Ma ..... G09G 3/20

FOREIGN PATENT DOCUMENTS

CN 108336120 A 7/2018

* cited by examiner

*Primary Examiner* — Ibrahim A Khan

(74) *Attorney, Agent, or Firm* — Anova Law Group PLLC

(57) ABSTRACT

The present disclose provides a display panel and a display device. The display panel includes a display area, a non-display area surrounding the display area, at least one notch, a cathode layer, a peripheral bus, and shift registers. A first non-display area and a second non-display area are oppositely disposed, and a third non-display area and a fourth non-display area are oppositely disposed. A cathode layer includes a cathode connection portion. A peripheral power bus is connected to the cathode connection portion in a cathode contact region. A first cathode contact region and first shift registers are located in a notched non-display area and are overlapped with each other. A second cathode contact region is located in the fourth non-display area. A width of the first cathode contact region in a first direction is less than a width of the second cathode contact region in a second direction.

19 Claims, 15 Drawing Sheets

DISPLAY PANEL AND DISPLAY DEVICE

CROSS-REFERENCES TO RELATED APPLICATIONS

This application claims the priority of Chinese Patent Application No. CN201910152306.1, filed on Feb. 28, 2019, the entire contents of all of which are incorporated herein by reference.

FIELD OF THE DISCLOSURE

The present disclosure generally relates to the field of display technologies and, in particular, relates to a display panel and a display device.

BACKGROUND

With the application of display technologies in smart wear and other portable electronic devices, the design of electronic products is constantly pursuing a smooth user experience, and at the same time, the sensory experience of users is increasingly pursued, for example, performance such as wide viewing angle, high resolution, narrow border, high screen ratio, etc., has become a selling point of various electronic products.

Currently, due to the pursuit of individualized designs by major manufacturers, irregularly-shaped display panels have emerged, including display panels with notches on sides of the display panels. That is, a notch is provided at a side position of a display panel where shift registers are usually provided. FIG. 1 is a schematic view of a display panel. As shown in FIG. 1, a notch K' is located on a side of the display panel. Due to the setting of the notch K', part of data lines D' in the display panel is blocked by the notch K'. To realize transmission of signal on the data lines D' on an upper side of the notch K', a winding R' is needed to be set in a non-display area BA', and the winding R' connects two data lines D' on both sides of the notch. A plurality of windings R' is needed to be set in the non-display area BA', resulting in a larger occupied area of the non-display area BA' and a larger border.

Therefore, it is an urgent problem to be solved in the art to provide a display panel and a display device capable of narrowing the border to increase the screen ratio.

BRIEF SUMMARY OF THE DISCLOSURE

One aspect of the present disclosure provides a display panel including a display area, a non-display area surrounding the display area, at least one notch, a cathode layer, a peripheral bus, and shift registers. An edge of the display panel is recessed toward an inside of the display area in a first direction to form the at least one notch. The non-display area includes a first non-display area, a second non-display area, a third non-display area, and a fourth non-display area. In the first direction, the first non-display area and the second non-display area are oppositely disposed. In a second direction, the third non-display area and the fourth non-display area are oppositely disposed. The second direction intersects with the first direction. The first non-display area includes a notched non-display area, and the notched non-display area partially surrounds the at least one notch. The third non-display area includes a fan-out area for setting signal lines to connect a driving chip to the display area. The cathode layer extends from the display region to the non-display region, and includes a cathode connection portion located in the non-display region. The peripheral power bus is located in the non-display area, that the non-display area includes a cathode contact region, the peripheral power bus is connected to the cathode connection portion in the cathode contact region, the cathode contact region includes a first cathode contact region and a second cathode contact region, the first cathode contact region is located in the notched non-display area, and the second cathode contact region is located in the fourth non-display area. The shift registers are located in the non-display area, that the shift registers include first shift registers, the first shift registers are located in the notched non-display area, and the first shift registers overlap with the first cathode contact region, in a direction perpendicular to the display panel; and in the first direction, a width of the first cathode contact region is D1, and in the second direction, a width of the second cathode contact region is D2, where D1<D2.

Another aspect of the present disclosure provides a display device including any of the display panels provided by the present disclosure.

Other aspects of the present disclosure can be understood by those skilled in the art in light of the description, the claims, and the drawings of the present disclosure. Further features of the present disclosure and its advantages will become apparent from the following detailed description of exemplary embodiments.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
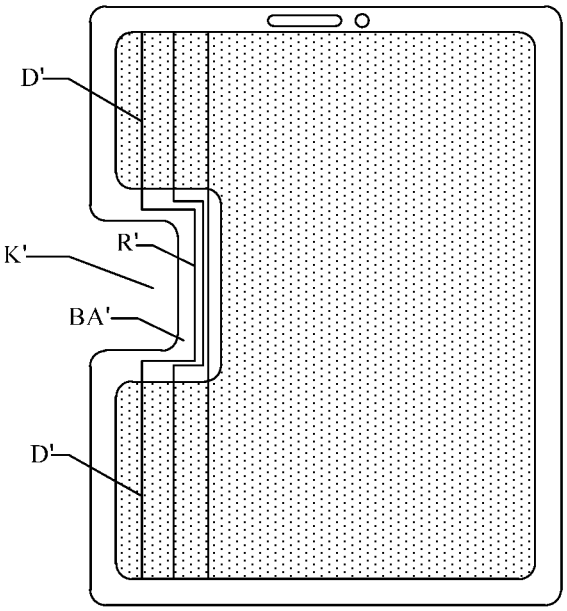
FIG. 1 is a schematic view of a display panel.

Various exemplary embodiments of the present disclosure are described in detail with reference to the drawings. It should be noted that the relative arrangement of the components and steps, numerical expressions, and numerical values set forth in the exemplary embodiments are not intended to limit the scope of the present disclosure unless otherwise specified.

The following description of at least one exemplary embodiment is merely illustrative, and never in any way limits the present disclosure and its application or use.

Techniques, methods, and apparatus known to those skilled in the art may not be discussed in detail, but the techniques, the methods, and the apparatus should be considered as part of the present disclosure, where appropriate.

In all of the examples shown and discussed herein, any specific values are to be construed as illustrative only and not as a limitation. Thus, other examples of the exemplary embodiments may have different values.

It should be noted that similar reference numerals and letters indicate similar items in the following drawings, and therefore, once an item is defined in one drawing, it is not required to be further discussed in the subsequent drawings.

Figure 2:
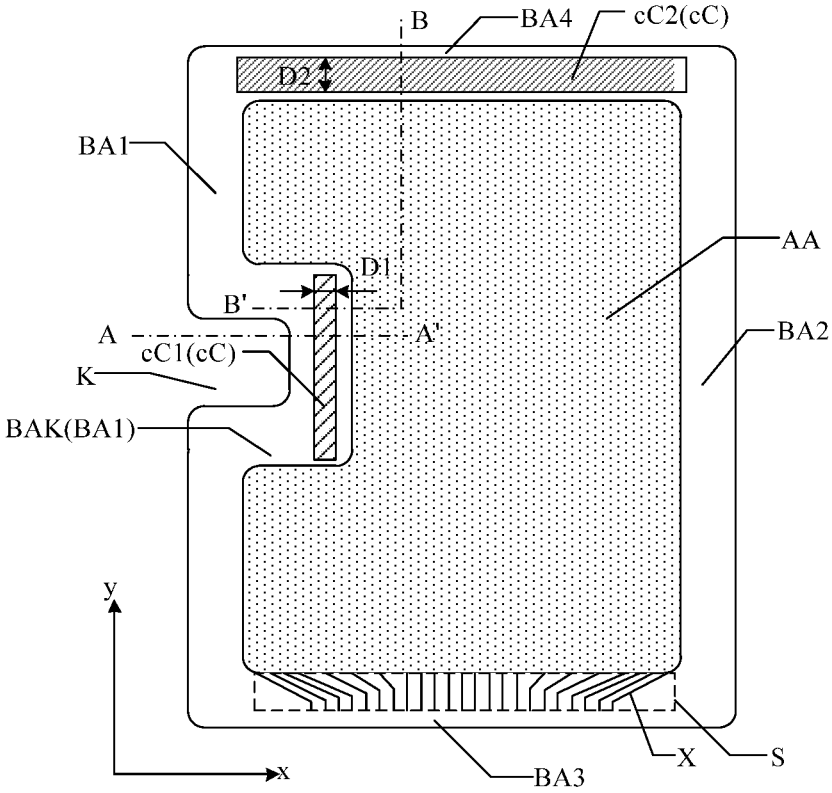
FIG. 2 is a schematic top view of an exemplary display panel according to one embodiment of the present disclosure.
Figure 3:
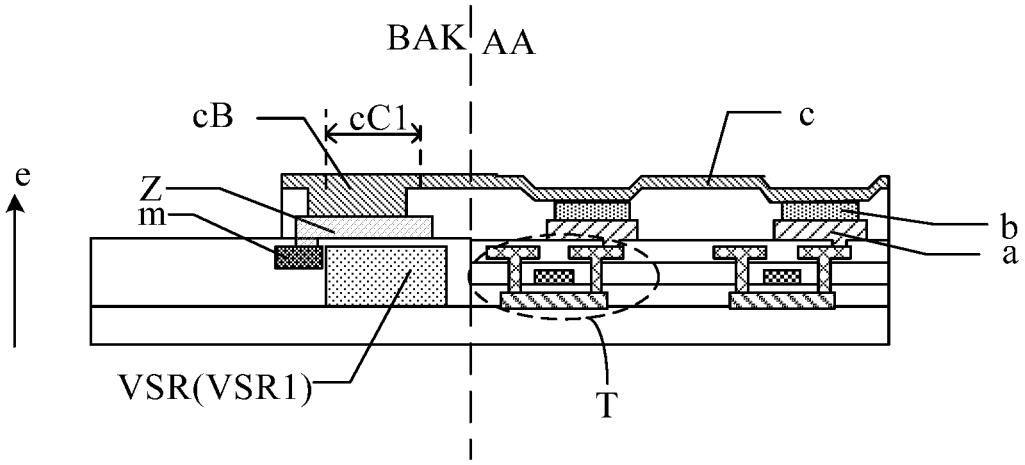
FIG. 3 is a schematic cross-sectional view showing an alternative embodiment of the position of the tangential line A-A' in FIG. 2.

FIG. 2 is a schematic top view of an exemplary display panel according to one embodiment of the present disclosure, and FIG. 3 is a schematic cross-sectional view showing an alternative embodiment of the position of the tangential line A-A' in FIG. 2.

As shown in FIG. 2, a display panel includes a display area AA, a non-display area disposed surrounding the display area AA, and at least one notch K. An edge of the display panel is recessed toward an inside of the display area AA in a first direction x to form a notch K. The shape of the notch K is not limited, may be a rectangle as illustrated in the drawing, and may be trapezoidal or circular. The non-display area includes a first non-display area BA1, a second non-display area BA2, a third non-display area BA3 and a fourth non-display area BA4. In the first direction x, the first non-display area BA1 and the second non-display area BA2 are oppositely disposed. In a second direction y, the third non-display area BA3 and the fourth non-display area BA4 are oppositely disposed. The second direction y intersects with the first direction x, and optionally, the second direction y and the first directions x may be perpendicular to each other. The first non-display area BA1 includes a notched non-display area BAK. The notched non-display area BAK partially surrounds the notch K. The third non-display area BA3 includes a fan-out area S for setting signal lines X to connect a driving chip to the display area AA, that the driving chip can be disposed in the third non-display area BA3, and the position of the driving chip is not shown in the figure.

As shown in FIG. 3, the display panel further includes: a cathode layer c extending from the display area AA to the non-display area, and including a cathode connection portion cB located in the non-display area. Shown in the schematic view in FIG. 3, the cathode layer c extends from the display area AA to the notched non-display area BAK. The display area AA of the display panel further includes a plurality of anodes a, a light-emitting device layer b, and thin film transistors T. The thin film transistors T may be one of a top gate structure and a bottom gate structure, which is only schematically shown in the drawing, and the thin film transistors T include a gate, a source, a drain, and an active layers (not shown in FIG. 3).

Referring to FIG. 3, the display panel further includes a peripheral power bus Z, located in the non-display area. The non-display area includes a cathode contact region cC, and the peripheral power bus Z is connected to the cathode connection portion cB in the cathode contact region cC. In the present disclosure, the cathode connection portion cB is defined as a portion where the cathode layer c is connected to the peripheral power bus Z. The peripheral power bus Z is connected to the driving chip, so that the driving chip supplys a voltage signal to the cathode layer through the peripheral power bus Z.

Referring to FIG. 2, the cathode contact region cC includes a first cathode contact region cC1 and a second cathode contact region cC2. The first cathode contact region cC1 is located in the notched non-display area BAK, and the second cathode contact region cC2 is located in the fourth non-display area BA4. As shown in FIG. 3, the peripheral power bus Z is connected to the cathode connection portion cB in the first cathode contact region cC1. In the cross-sectional schematic view, the first cathode contact region cC1 is at a side away from the display area AA, and the notched non-display area BAK also includes a package structure (package metal and sealant), which is not shown in the drawing. Only an arrangement of cathode contact regions in the notched non-display area BAK and the fourth non-display area BA4 is illustrated in FIG. 2, and an arrangement of cathode contact regions in other areas of the non-display area is not limited herein. Optionally, as shown in FIG. 3, the display panel further includes a cathode voltage signal line m. The cathode voltage signal line m is disposed surrounding the display area, the peripheral source bus Z is connected to the cathode voltage signal line m through openings, and the cathode voltage signal m is connected to the driving chip. The driving chip supplys a voltage signal to the cathode layer through the cathode voltage signal line m, that the cathode voltage signal line m can be fabricated in a same layer as the source and the drain of the thin film transistors T. In some optional embodiments, the display panel provided by the present disclosure may also not provide the cathode voltage signal line m surrounding the display area.

Shift registers VSR are located in the non-display area, and the shift registers VSR include first shift registers VSR1, that the shift registers VSR can be a scan shift register for driving a scan line, and can also be an illumination shift register for driving an illumination signal line. As shown in FIG. 3, the first shift registers VSR1 are located in the notched non-display area BAK, and the shift registers include a plurality of components. FIG. 3 is only a simplified schematic. The first shift registers overlap with the first cathode contact region cC1 in a direction e perpendicular to the display panel. With continued reference to FIG. 2, in the first direction x, a width of the first cathode contact region cC1 is D1, and in the second direction y, a width of the second cathode contact region cC2 is D2, where D1<D2.

Figure 4:
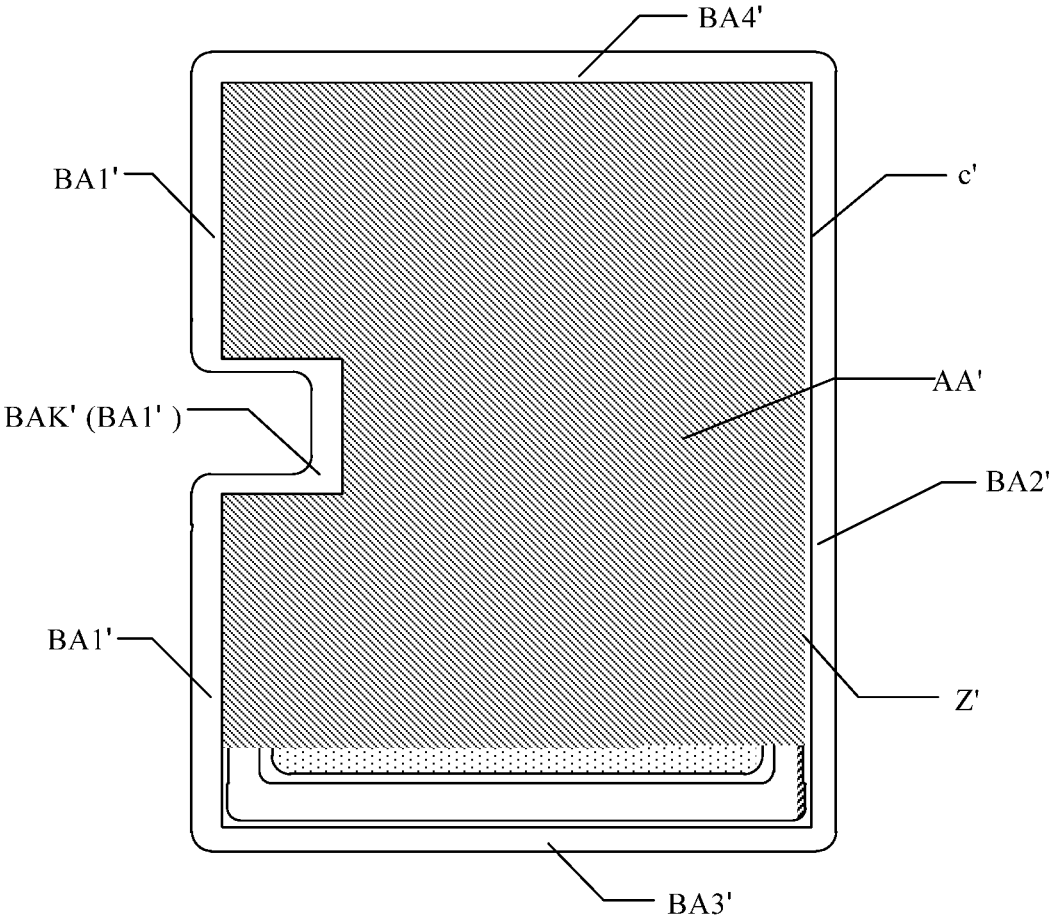
FIG. 4 is a schematic view of another display panel.

In a conventional display panel, a peripheral power bus surrounding a display area is usually disposed in a non-display area, and a cathode layer is connected to the peripheral power bus to provide a voltage signal for the cathode layer in the display area. As shown in FIG. 4, in a conventioanl display panel, a peripheral power bus Z' surrounding a display area AA' is disposed in a non-display area. In a first non-display area BA1', in a second non-display area BA2', in a third non-display area BA3', and in a fourth non-display area BA4', the peripheral power bus Z' is provided. A cathode layer c' is electrically connected to the peripheral power bus Z' after extending to the non-display area. Widths of the peripheral power bus Z' are usually equal in the first non-display area BA1', in the second non-display area BA2', and in the the four non-display areas BA4'. A cathode contact region is a region where the peripheral power bus and a cathode connection portion are connected; therefore it can be understood that widths of cathode contact regions are equal in the first non-display area BA1', in the second non-display area BA2', and in the fourth non-display area BA4'. In the conventional display panel, in order to reduce the resistance of the cathode layer, the peripheral power bus Z' surrounding the display area AA' is disposed in the non-display area, and the cathode layer c' is in contact with the peripheral power bus Z' (in the cathode contact region), which can reduce the resistance of the cathode layer, thereby reducing voltage drop. Conventionally, in order to reduce the resistance of the cathode layer to a certain value, it is necessary to design contact area between the peripheral power bus Z' and the cathode layer c' to reach a certain value, that is, the cathode contact region located in the non-display area needs to have a certain width.

The inventors have found that when a conventional design is applied to a display panel having a notch on a side, and a cathode contact region and shift registers have to be simultaneously disposed in a notched non-display area BAK', the cathode contact region and the shift registers overlap each other in a direction perpendicular to the display panel; therefore design of a width of the shift registers is limited by a width of the cathode contact region. Using a conventional idea of those skilled in the art, in order to reduce the resistance of the cathode layer, the width of the overlapping shift registers is designed according to the width of the cathode contact region, thereby resulting in a larger width of the notched non-display area. However, the inventors of the present disclosure have found that the size of conventioanl shift registers still has room to reduce.

In the display panel provided by the present disclosure, the width D1 of the first cathode contact region is set to be smaller than the width D2 of the second cathode contact region, that is, the width of the cathode contact region in the notched non-display area is smaller than the width of the cathode contact region in the fourth non-display area. As a result, when shift registers are disposed in the notched non-display area, a width of the shift registers can be further reduced, thereby reducing the occupied space by the cathode contact region in the notched non-display area and faciliating narrowing of the notched non-display area.

Figure 5:
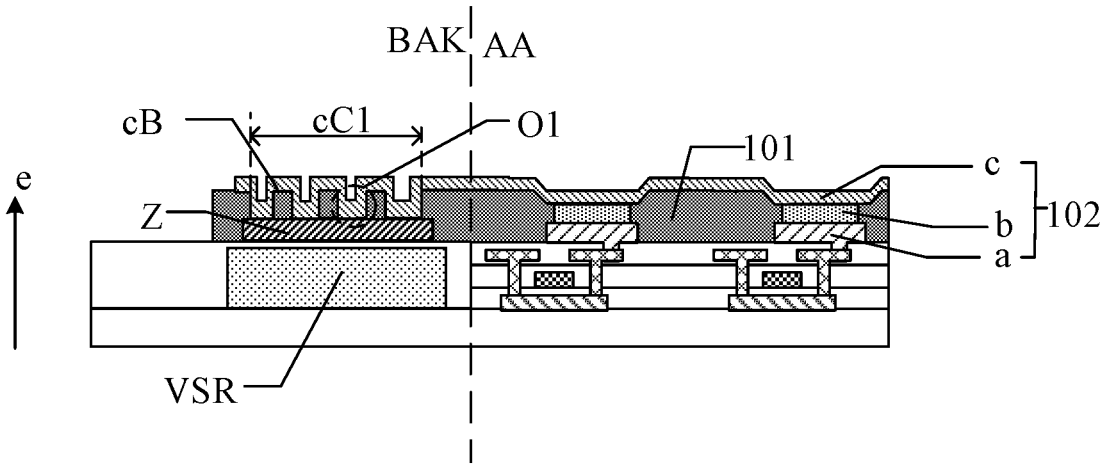
FIG. 5 is a cross-sectional view showing another alternative embodiment of the position of the tangential line A-A' in FIG. 2.

In one embodiment, FIG. 5 is a cross-sectional view showing another alternative embodiment of the location of the tangential line AA' in FIG. 2. As shown in FIG. 5, it is illustrated that the cathode layer c extends from the display area AA to a non-display area BA. The figure shows an example of extending to the notched non-display area BAK. The display panel further includes a pixel defining layer 101 and a light emitting device layer 102. The light emitting device layer 102 is located on a side of the pixel defining layer 101 adjacent to a light exiting surface of the display panel. The light exiting surface is a display surface of the display panel, and a light emitted by the light emitting device layer 102 exits from the light exiting surface. The pixel defining layer 101 has a plurality of first openings O1. In the first cathode contact region cC1, the cathode connection portion cB is electrically connected to the peripheral power bus Z through the plurality of first openings O1. The light emitting device layer 102 includes a plurality of anodes a insulated from each other, and the peripheral power bus Z is located on a same film layer as the plurality of anodes a. The light emitting device layer 102 further includes a light emitting layer b. After a voltage is applied to the plurality of anodes a and the cathode layer c, respectively, the light emitted from the light emitting layer b is emitted through the cathode layer c. Optionally, the material of the plurality of anodes a is made of one of metal material and metal oxide material to form a reflective electrode having a reflective function, and the material of the cathode layer c is made of one of aluminum, magnesium and a combination thereof to form a relatively thin translucent cathode.

In one embodiment, the cathode connection portion is connected to the peripheral power bus through the plurality of first openings, and setting the plurality of first openings in the pixel defining layer can increase an area of the cathode connection portion, increase an area of the cathode layer, and is beneficial to reduce the overall resistance of the cathode layer, thereby reducing voltage drop across the cathode layer and reducing power consumption when a voltage signal is supplied to the cathode layer through the peripheral power bus. In addition, setting the plurality of first openings can increase contact area between the cathode layer and the pixel defining layer, and the cathode layer may have better adhesion with the pixel defining layer, thereby enhancing the stability of the film layer structure.

Figure 6:
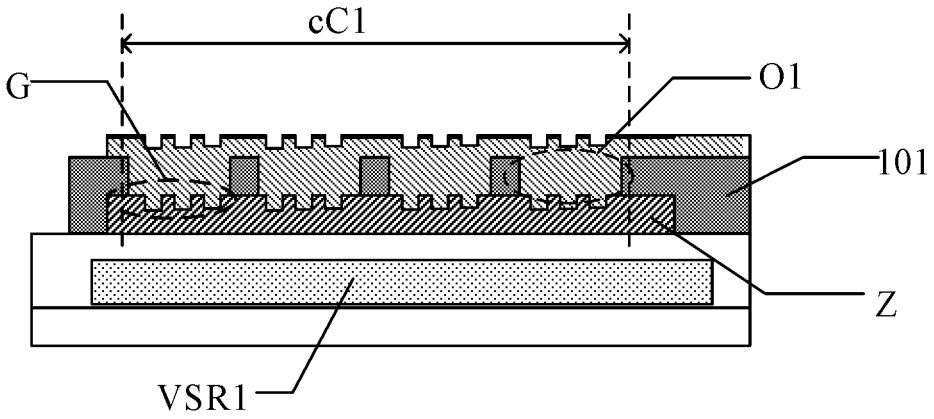
FIG. 6 is a cross-sectional view showing an alternative embodiment of a notched non-display area according to one embodiment of the present disclosure.

In one embodiment, FIG. 6 is a cross-sectional view showing an alternative embodiment of a notched non-display area in a display panel according to one embodiment of the present disclosure. As shown in FIG. 6, only a cross-section of a portion where the first cathode contact region cC1 is located is illustrated, and the cathode connection portion cB in the first cathode contact region cC1 is electrically connected to the peripheral power bus Z through first openings O1. In the first cathode contact region cC1, the peripheral power bus Z has a concave-convex structure G, and the cathode connection portion cB is in contact with the concave-convex structure G. The concave-convex structure G in FIG. 6 is only a schematic representation. Optionally the concave-convex structure G in the cross-sectional schematic view may also be wavy, tapered or other shape that can increase the surface area of the peripheral power bus. In one embodiment, the concave-convex structure of the peripheral power bus can increase the surface area of the peripheral power bus, and the cathode connection portion is in contact with the concave-convex structure, that is, the contact area between the cathode connection portion and the peripheral power bus can be increased, which is advantageous for reducing the electric resistance of the cathode layer as a whole, thereby compensating for the resistance increase of the cathode layer caused by setting the width D1 of the first cathode contact region being smaller than the width D2 of the second cathode contact region in the present disclosure, and ensuring that the notched non-display region is narrowed while the display panel power consumption is not increased.

Figure 7:
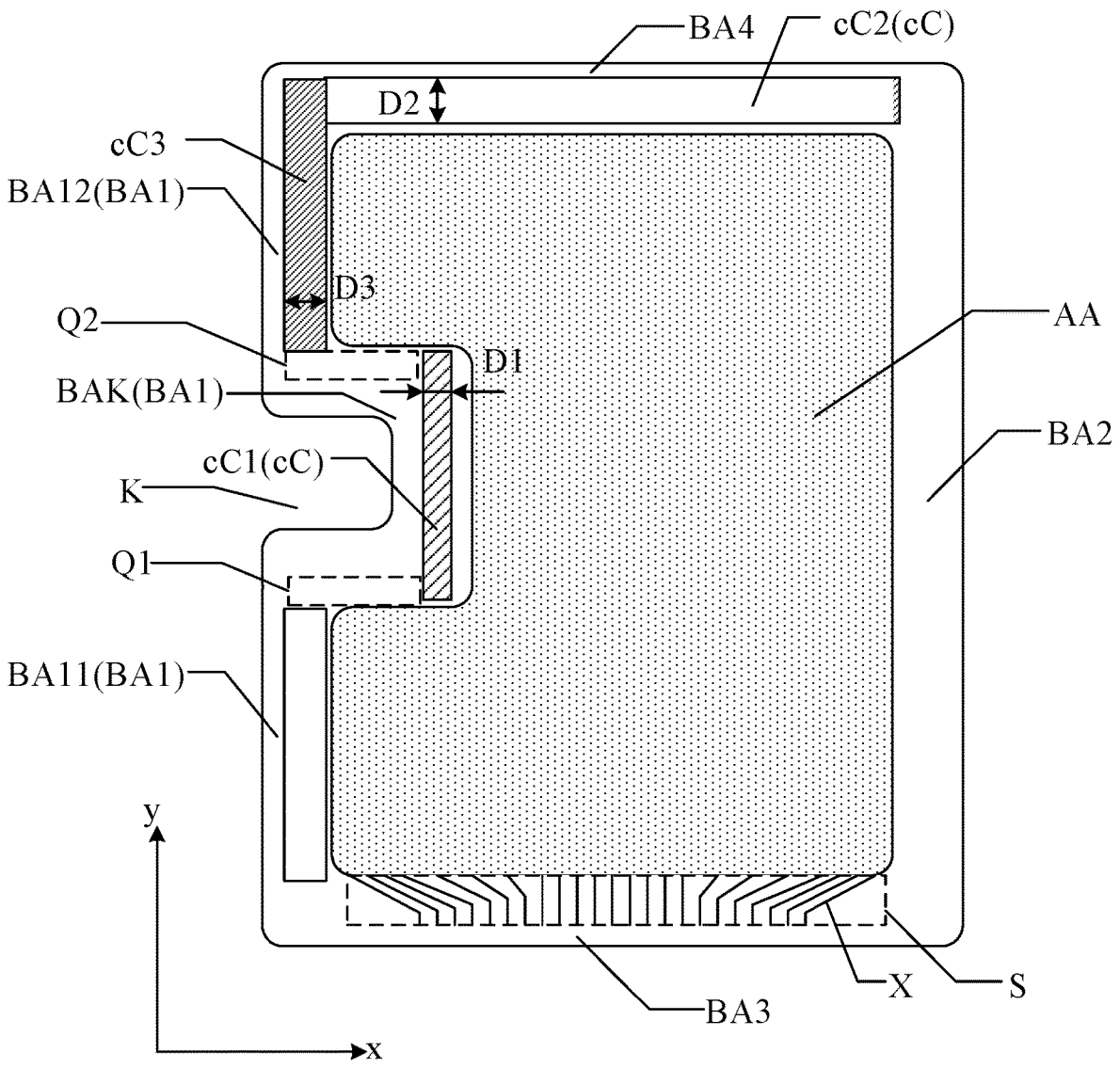
FIG. 7 is a schematic view of an alternative embodiment of the display panel according to one embodiment of the present disclosure.

In one embodiment, FIG. 7 is a schematic view of another alternative embodiment of the display panel according to one embodiment of the present disclosure. As shown in FIG. 7, the first non-display area BA1 further includes a first sub-non-display area BA11 and a second sub-non-display area BA12. In the second direction y, the first sub-non-display area BA11 and the second sub-non-display area BA12 are respectively located on both sides of the notched non-display area BAK. In the second direction y, lengths of the first sub-non-display area BA11 and the second sub-non-display area BA12 may be the same and may also be different. The cathode contact region further includes a third cathode contact region cC3, each of the first sub-non-display region BA11 and the second sub-non-display region BA12 includes the third cathode contact region cC3. In the first direction x, a width of the third cathode contact region cC3 is D3, where D1<D3.

Optionally, a region Q1 and a region Q2 in the figure may not include a cathode contact region, but only include the peripheral power bus used for voltage signal transmission via the peripheral power bus Z in the first cathode contact region cC1 and the third cathode contact region cC3. A line width of the peripheral power bus in the region Q1 and the region Q2 can be smaller. Alternatively, the peripheral power bus may be provided only in the region Q1, and the peripheral power bus in the region Q1 is electrically connected to the peripheral power bus Z in the third cathode contact area cC3. Optionally, D3<D2.

Figure 8:
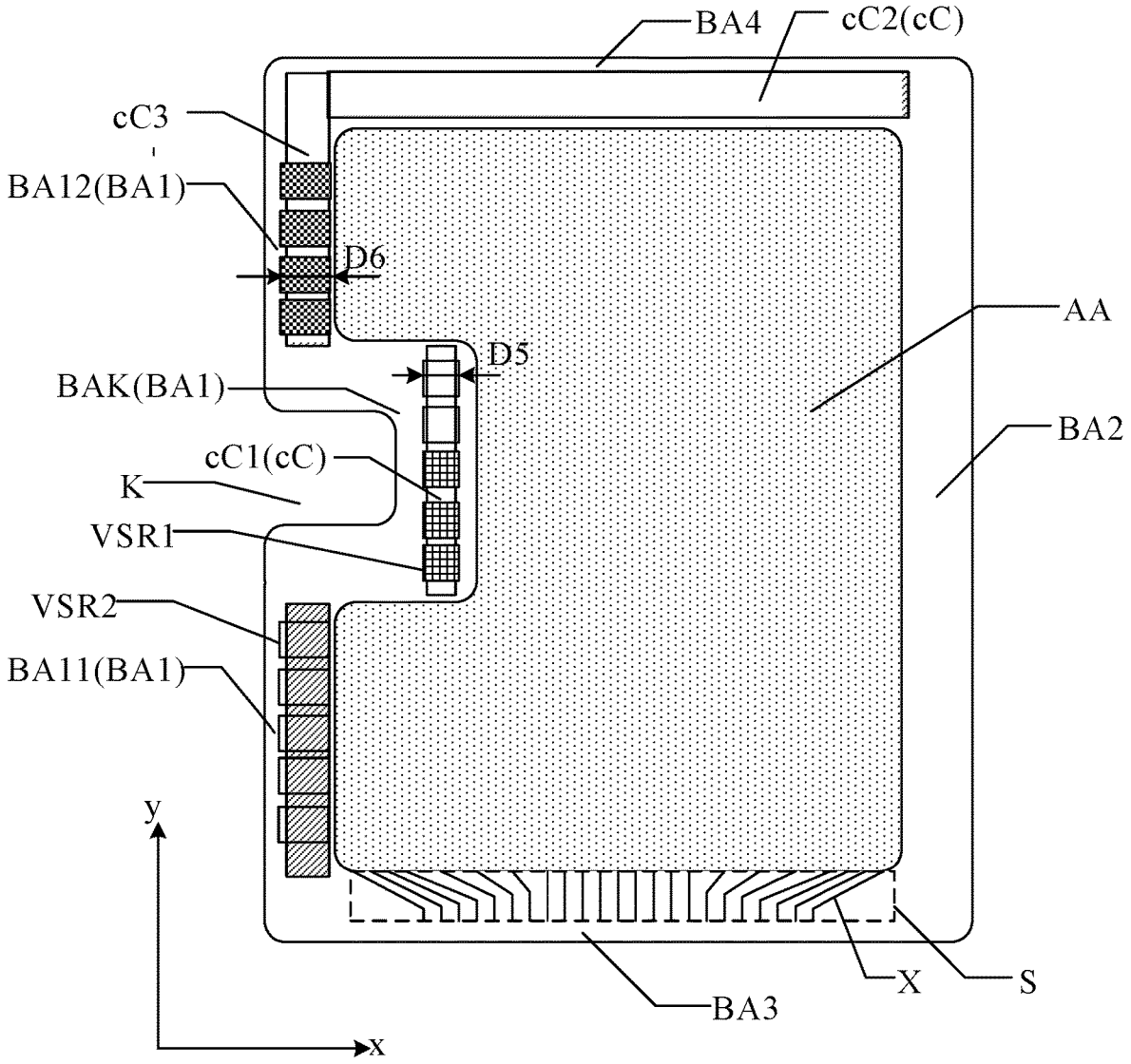
FIG. 8 is a schematic view of another alternative embodiment of the display panel according to one embodiment of the present disclosure.

In one embodiment, FIG. 8 is a schematic view of another alternative embodiment of the display panel according to one embodiment of the present disclosure. As shown in FIG. 8, the shift registers further include second shift registers VSR2, and the second shift registers VSR2 are disposed in each of the first sub-non-display area BA11 and the second sub-non-display area BA12. In the first direction x, a width D5 of the first shift registers VSR1 is smaller than a width D6 of the second shift registers VSR2. In the notched non-display area, the first shift registers overlap with the first cathode contact region. In one embodiment, the width D1 of the first cathode contact region is set to be smaller than the width D3 of the third cathode contact region, and the width of the first shift registers is smaller than the width of the second shift registers, that is, in the notched non-display area, the width occupied by the cathode contact region and the width occupied by the shift registers are simultaneously reduced in the first direction, thereby realizing narrowing of the notched non-display area in the first direction.

In the present disclosure, the width of the first shift registers is smaller than the width of the second shift registers, which may be implemented by adjusting the size of the devices in the first shift registers, or by using different structures to form the first shift registers and the second shift registers.

Figure 9:
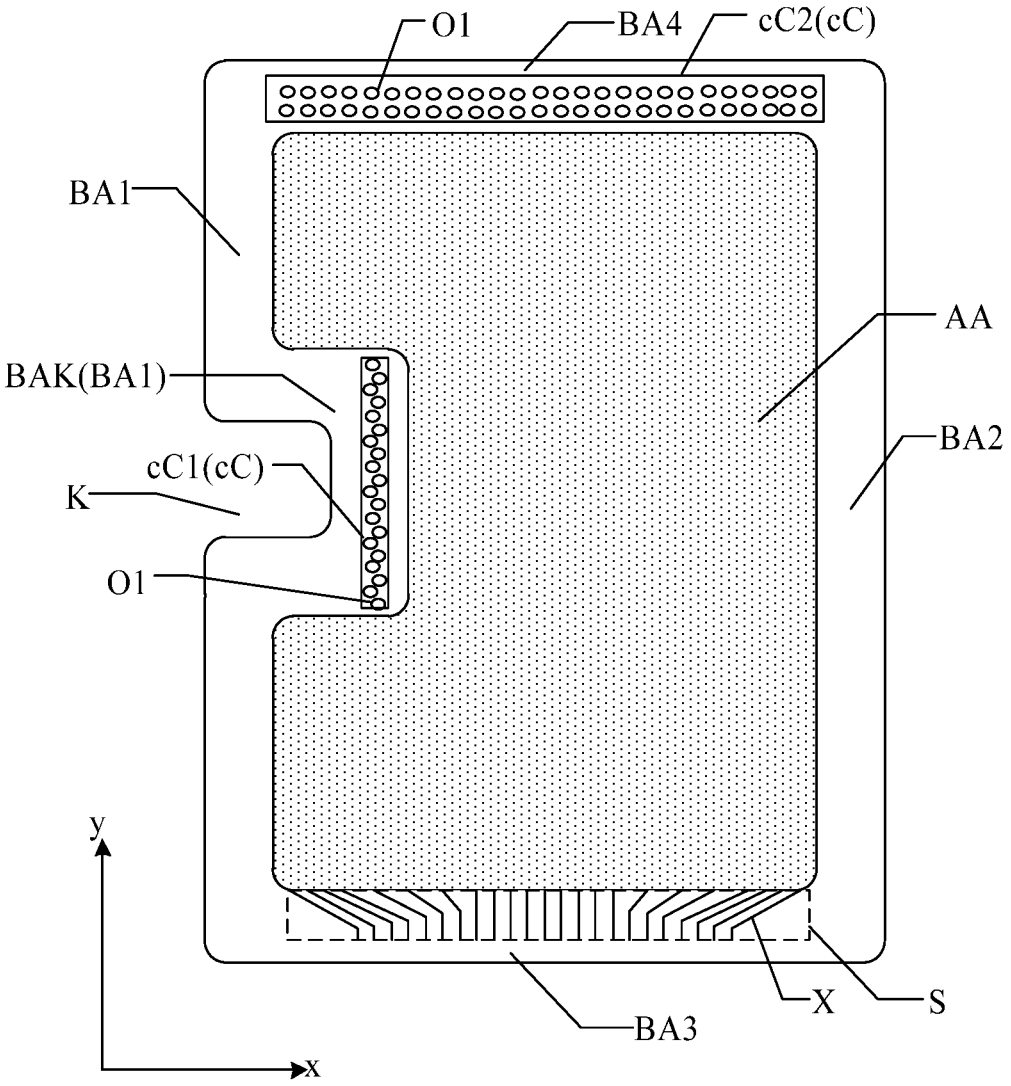
FIG. 9 is a schematic view of another alternative embodiment of the display panel according to one embodiment of the present disclosure.

As shown in FIG. 5, the display panel further includes the pixel defining layer 101 and the light emitting device layer 102. The light emitting device layer 102 is located on the side of the pixel defining layer 101 adjacent to the light exiting surface of the display panel. The pixel defining layer 101 has the plurality of first openings O1, the cathode connection region cB in the cathode contact region cC is electrically connected to the peripheral power bus Z through the plurality of first openings O1. In one embodiment, FIG. 9 is a schematic view of another alternative embodiment of the display panel according to one embodiment of the present disclosure. As shown in FIG. 9, a density of the plurality of first openings O1 in the first cathode contact region cC1 is larger than a density of the plurality of first openings O1 in the second cathode contact region cC2. The figure is only an arrangement of the plurality of first openings O1 in the first cathode contact region cC1 and the second cathode contact region cC2, and is not intended to limit the present disclosure. In one embodiment, the density of the plurality of first openings provided in the pixel defining layer 101 in the first cathode contact region is larger, so that contact area between the cathode connection portion and the peripheral power bus in the first cathode contact region can be increased, thereby facilitating reduction of overall resistance of the cathode layer and compensating for the increase of the cathode layer resistance caused by setting the width D1 of the first cathode contact region being smaller than the width D2 of the second cathode contact region in the present disclosure, thereby ensuring narrowing of the notched non-display area while not increasing the power consumption of the display panel.

Figure 10:
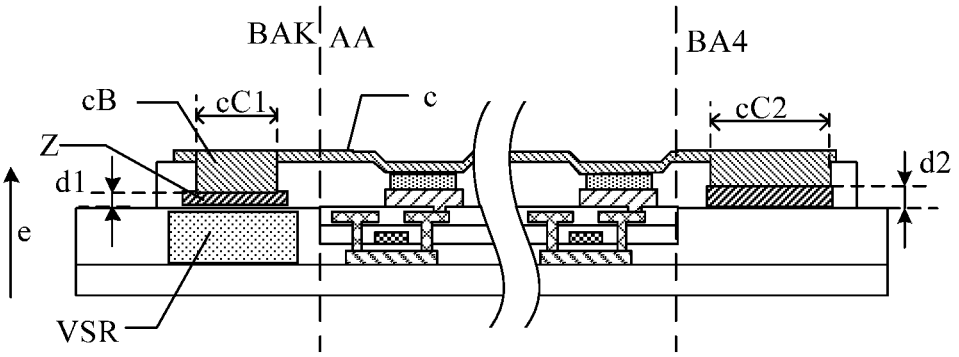
FIG. 10 is a cross-sectional view of an alternative embodiment taken along line BB' of FIG. 2.

In one embodiment, FIG. 10 is a cross-sectional view of an alternative embodiment taken along line BB' of FIG. 2. FIG. 10 illustrates a cross-sectional comparison of the notched non-display area BAK and the fourth non-display area BA4 of the display panel. As shown in FIG. 10, in the direction e perpendicular to the display panel, a thickness of the peripheral power bus Z in the first cathode contact region cC1 is d1, and a thickness of the peripheral power bus Z in the second cathode contact region cC2 is d2, where d1<d2. When a voltage signal is supplied to the cathode layer in the display panel, the direction of the voltage signal flows from the peripheral power bus to the cathode connection portion and then to the cathode layer located in the display area. One embodiment sets d1<d2 to reduce the transmission path of the voltage signal in the first cathode contact region, which is equivalent to reducing the voltage drop during the transmission of the voltage signal to the cathode layer, thereby compensating the resistance increase in the cathode layer caused by setting the width D1 of the first cathode contact region being smaller than the width D2 of the second cathode contact region in the present disclosure, and ensuring that the narrowing of the notched non-display area is achieved without increasing the power consumption of the display panel. Optionally, the peripheral power bus is located in a same film layer as the plurality of anodes of the display area, for example, the plurality of anodes adopts an ITO/Ag/ITO structure (i.e., a three-layer structure) during fabrication, and the peripheral power bus in the first cathode contact region can adopt an ITO/Ag structure (i.e., a two-layer structure), in order to thin the peripheral power bus in the first cathode contact region.

Figure 11:
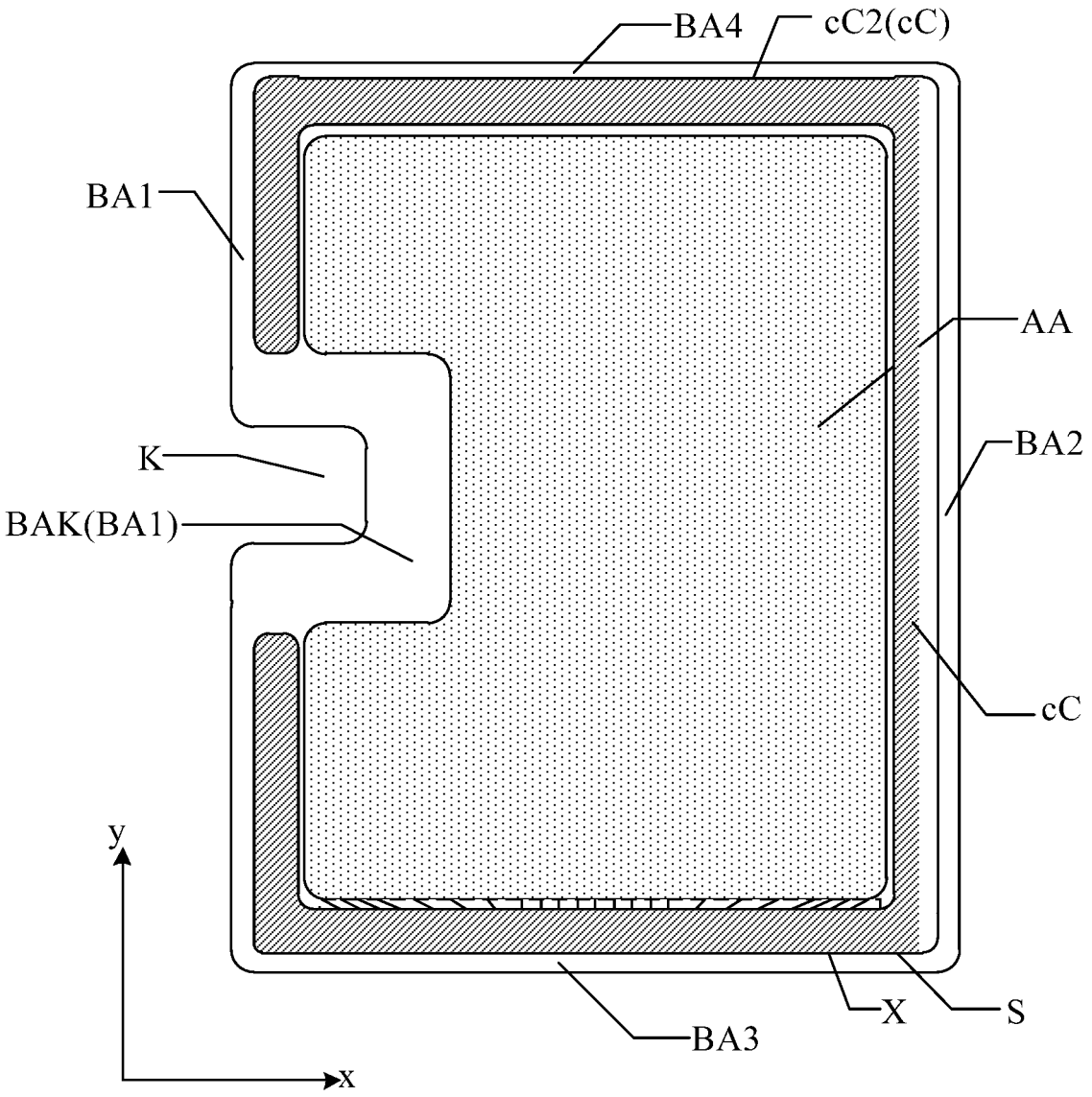
FIG. 11 is a schematic view of another alternative embodiment of the display panel according to one embodiment of the present disclosure.

In one embodiment, FIG. 11 is a schematic view of another alternative embodiment of the display panel according to one embodiment of the present disclosure. As shown in the top view of FIG. 11, the cathode contact region cC is a non-closed pattern disposed around the display region AA, and the cathode contact region cC is not disposed in the notched non-display region BAK, i.e., D1=0 of the first cathode contact region. In one embodiment, the space of the notched non-display area can be saved to a large extent, and the narrowing of the notched non-display area can be realized.

Figure 12:
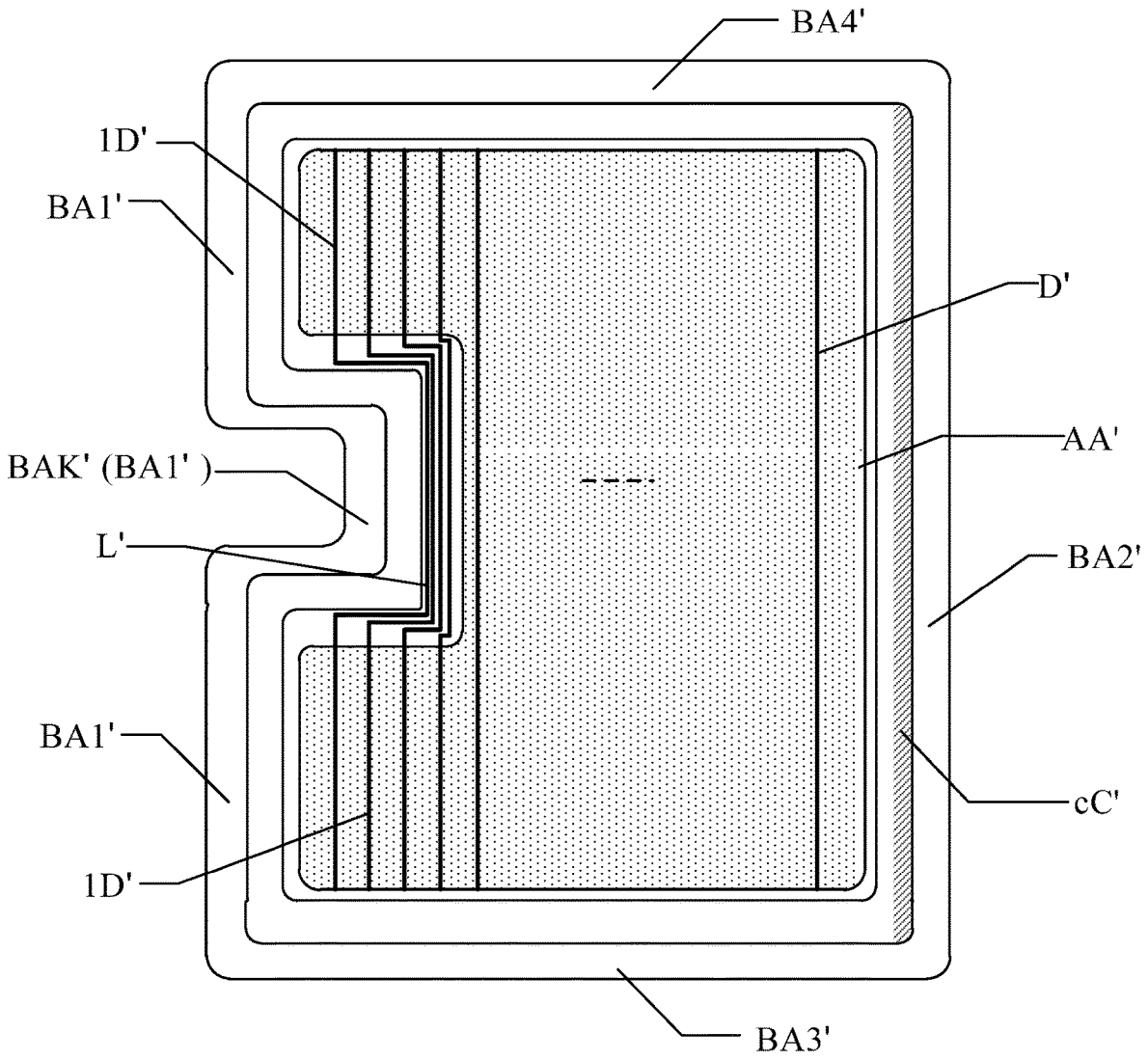
FIG. 12 is a schematic view of another display panel.

FIG. 12 is a schematic view of another conventional display panel. As shown in FIG. 12, first data lines 1D' in a display area AA' are cut off by a notch K', and connection lines L' are set in a notched non-display area BAK' to connect two first data lines 1D' on two sides of the notch K'. A cathode contact region cC' surrounding the display area AA' is provided, and a width of the cathode contact region cC' in the notched non-display region BAK' is the same as a width of the cathode contact region cC' in the fourth non-display region when no design change is made. That is, having the cathode contact region cC' in the notched non-display area BAK' while also providing a plurality of connection lines L' results in a large width of the notched non-display area BAK'.

Figure 13:
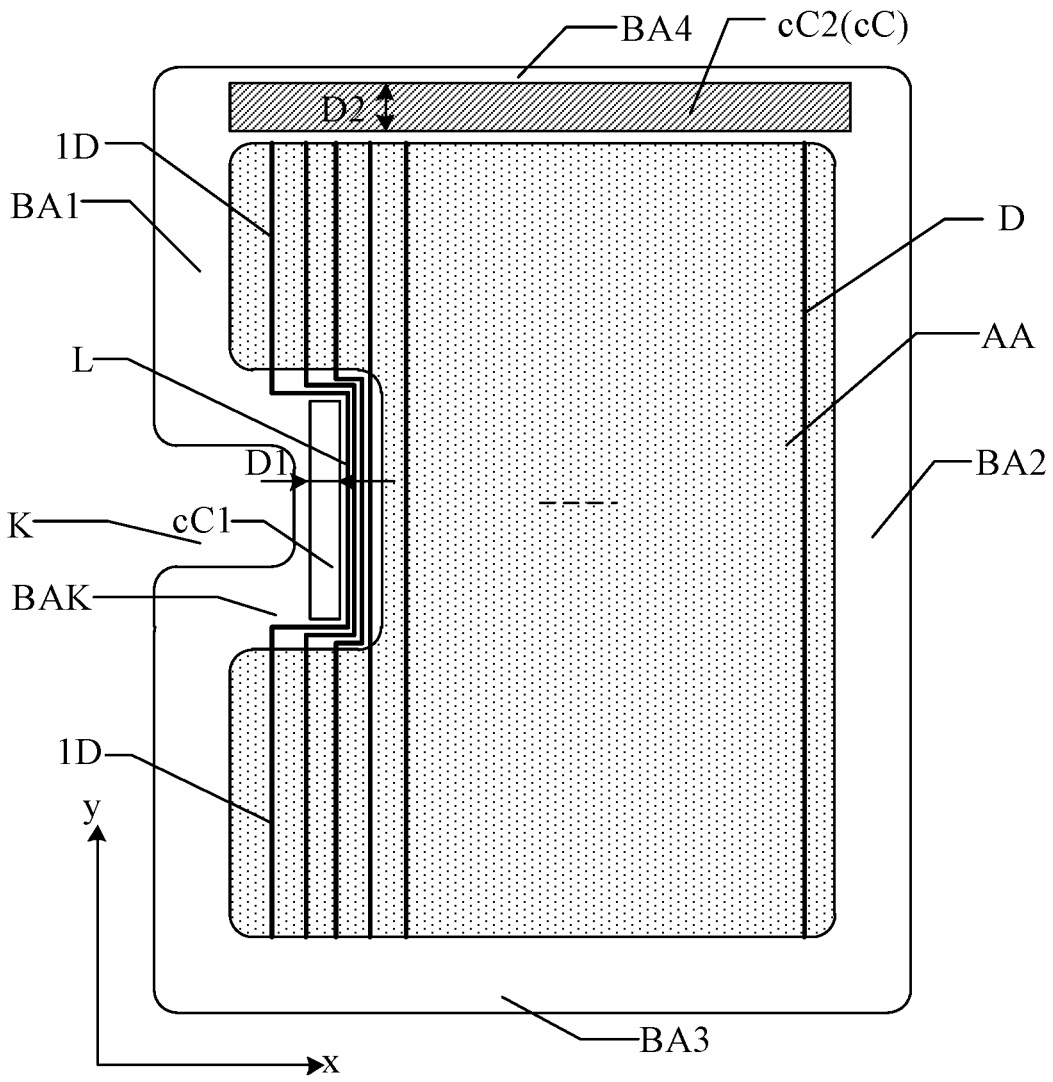
FIG. 13 is a schematic view of another alternative embodiment of the display panel according to one embodiment of the present disclosure.

In one embodiment provided by the present disclosure, FIG. 13 is a schematic view of another alternative embodiment of the display panel according to one embodiment of the present disclosure. As shown in FIG. 13, the display area AA further includes a plurality of data lines D extending in the second direction y, the plurality of data lines D includes first data lines 1D, and the first data lines 1D are cut by the notch K. The display panel further includes connection lines L, and the connection lines L are located in the notched non-display area BAK. Two first data lines 1D located on both sides of the notch K and located in a same column are connected by the connection lines L. In the first direction x, the width of the first cathode contact region cC1 is D1, and in the second direction y, the width of the second cathode contact region cC2 is D2, where D1<D2. Unlike the display panel shown in FIG. 12, the width of the first cathode contact region cC1 in the notched non-display area BAK is smaller than the width of the second cathode contact region cC2 in the fourth non-display area BA4. Assuming a same number of connection lines are needed in the display panel shown in FIG. 12 and the display panel shown in FIG. 13, the space occupied by the first cathode contact region and all the connecting lines in the notched non-display area in FIG. 13 is smaller than the space occupied by the cathode contact region and all the connecting lines in the notched non-display area in FIG. 12. The present disclosure can save the space of the notched non-display area and realize the narrowing of the notched non-display area.

FIG. 13 is only illustrated a case in where the first cathode contact region is included in the notched non-display area. Alternatively, another embodiment in which the connection lines are disposed in the notched non-display area is also applicable to the notched non-display area corresponding to the above-mentioned FIG. 11 in which the first cathode contact region is not disposed, and is not described herein.

Figure 14:
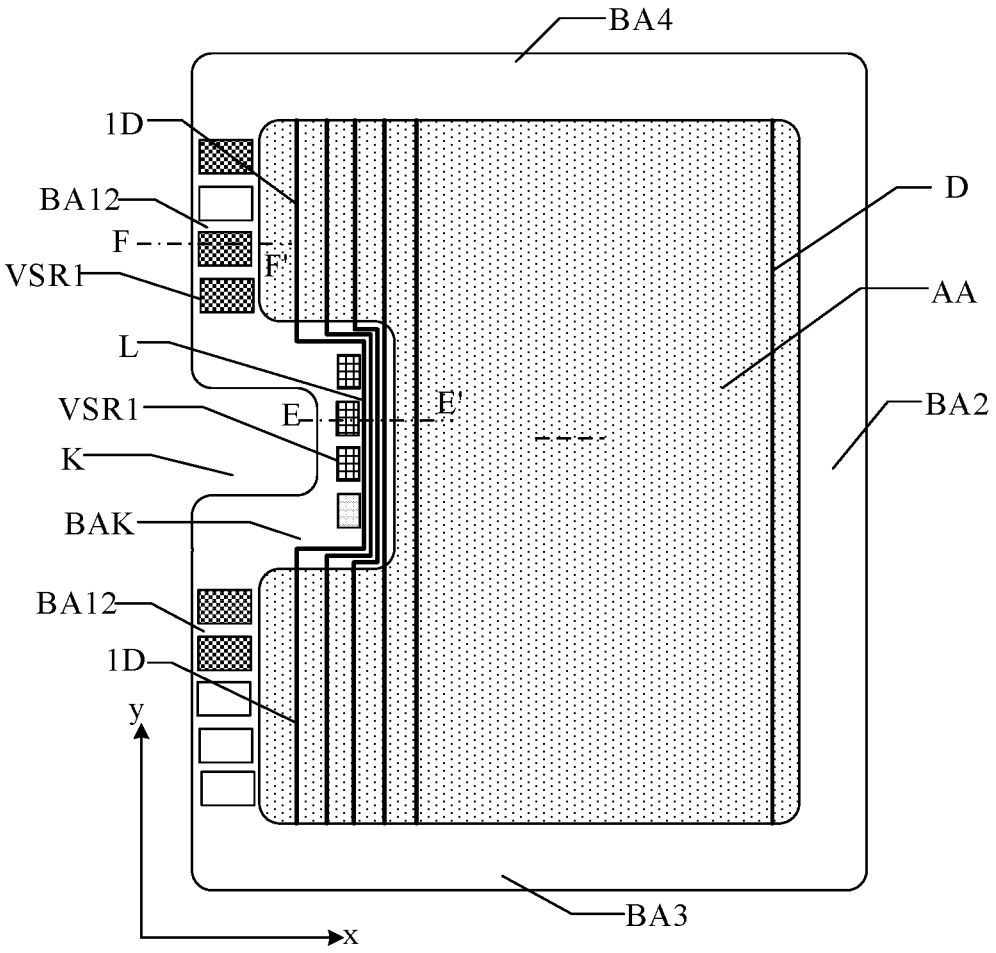
FIG. 14 is a schematic view of another alternative embodiment of the display panel according to one embodiment of the present disclosure.
Figure 15:
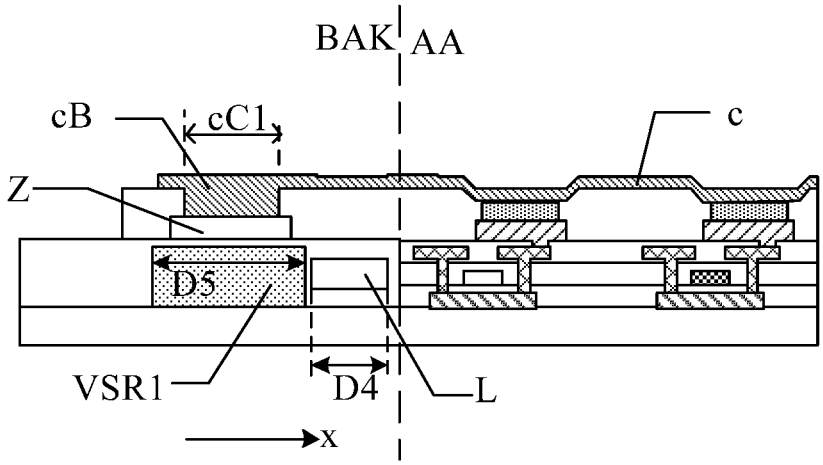
FIG. 15 is a schematic cross-sectional view of the position of the tangential line E-E' in FIG. 14.
Figure 16:
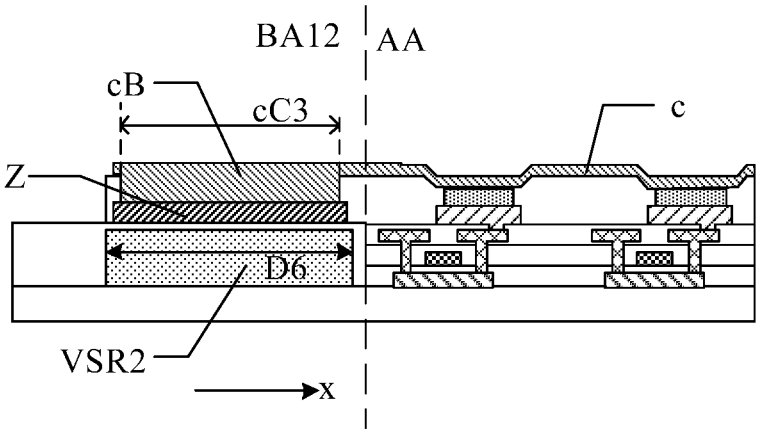
FIG. 16 is a schematic cross-sectional view of the position of the tangential line F-F' in FIG. 14.

Further, FIG. 14 is a schematic view of another alternative embodiment of the display panel according to one embodiment of the present disclosure. In order to clearly illustrate a width relationship of the shift registers and the connection lines, the cathode contact region located in the non-display area is not shown in FIG. 14. FIG. 15 is a schematic cross-sectional view of the position of the tangential line E-E' in FIG. 14, and FIG. 16 is a schematic cross-sectional view of the position of the tangential line F-F' in FIG. 14. As shown in FIG. 14, the connection lines L are located on a side of the first shift registers VSR1 adjacent to the display area AA. In the first direction x, a sum of widths of all the connection lines L is D4, and the shift registers further include the second shift registers VSR2. In each of the first sub-non-display area BA11 and the second sub-non-display area BA12, the second shift registers VSR2 are disposed. In the first direction x, the width of the first shift registers VSR1 is D5, the width of second shift registers VSR2 is D6, and D4+D5<D6. FIG. 15 is an example in which the first cathode contact region cC1 is disposed in the notched non-display area BAK, the first cathode contact region cC1 overlaps with the first shift registers VSR1, and the first shift registers VSR1 and the connection lines L are both located in an array layer of the display panel, so the first shift registers VSR1 and the connection lines L need to occupy a certain width in the first direction x. Only the connection lines L are illustrated in FIG. 15. Optionally, the first cathode contact region may not be disposed in the notched non-display area BAK, and the relative positions of the first shift registers VSR1 and the connection lines L may be referred to the schematic diagram in FIG. 15. FIG. 16 is an example in which the third cathode contact region cC3 is disposed in the second sub-non-display area BA12, and the third cathode contact region cC3 overlaps with the second shift registers VSR2. In the present disclosure, the width of the first shift registers in the first direction is reduced by design to ensure that a sum of the width of the first shift registers and the width of the connection lines in the first direction after adding the connecting lines in the notched non-display area is still smaller than the width of the second shift registers, and ensure that the space occupied by the first shift registers and the connection lines in the notched non-display area is small, which is advantageous for narrowing the notched non-display area.

Figure 17:
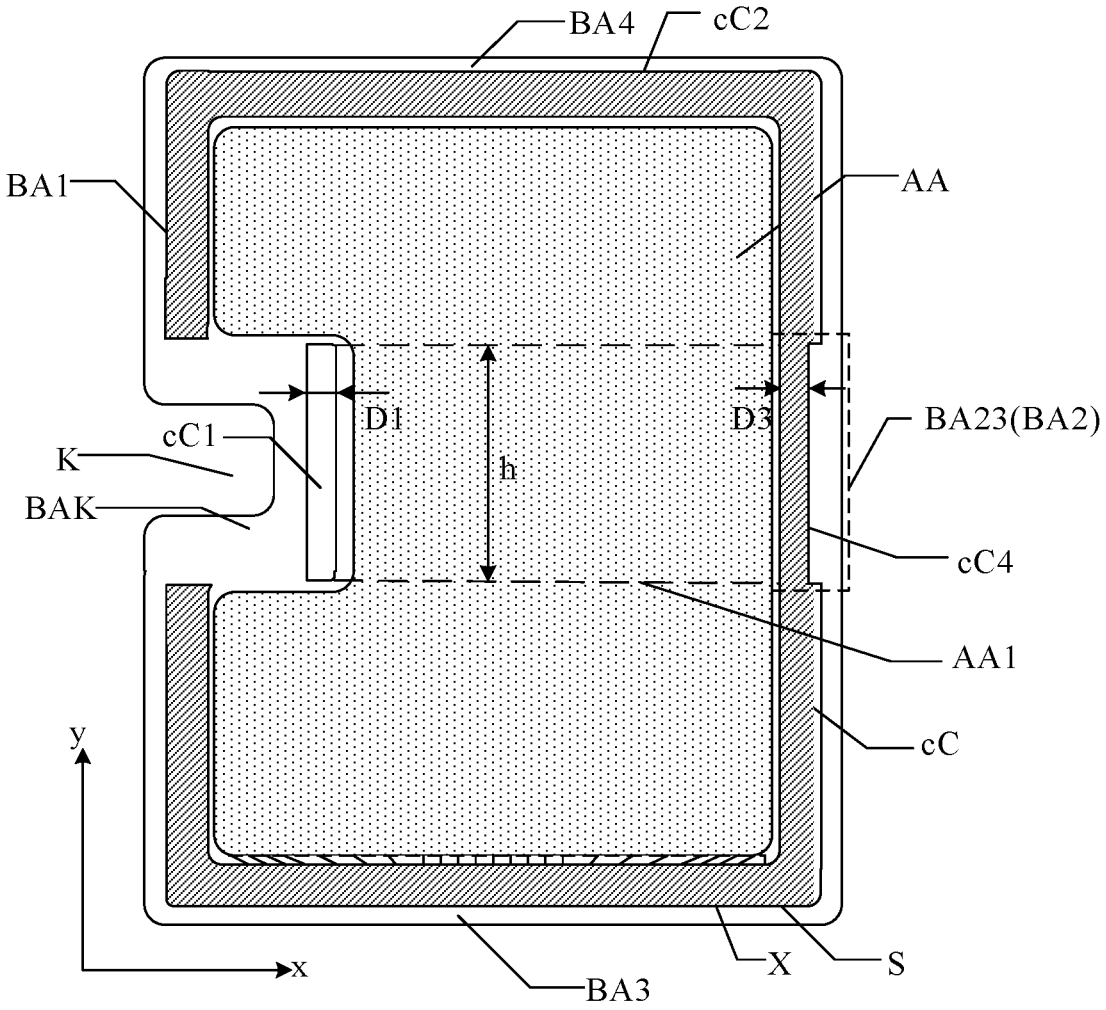
FIG. 17 is a schematic view of another alternative embodiment of the display panel according to one embodiment of the present disclosure.

In another embodiment, FIG. 17 is a schematic view of another alternative embodiment of the display panel according to one embodiment of the present disclosure. As shown in FIG. 17, the second non-display area BA2 further includes a third sub-non-display area BA23, the cathode contact region includes a fourth cathode contact region cC4, and the fourth cathode contact region cC4 is located in the third sub-non-display area BA23. In the first direction x, a width of the fourth cathode contact region cC4 is D3, and D3=D1. In the present disclosure, the width D1 of the first cathode contact region cC1 is set to be smaller than the width D2 of the second cathode contact region cC2, thereby facilitating reducing the space occupied by the first cathode contact region cC1 in the notched non-display region BAK, and realizing narrowing the notched non-display region BAK. The peripheral power bus is connected to the cathode connection portion in the cathode contact region. When the display panel is displayed, the voltage signal provided by the driving chip is transmitted to the cathode connection portion via the peripheral power bus and then transmitted to the cathode layer located in the display area. In the present disclosure, the width of the first cathode contact region cC1 is narrowed, and the contact area between the peripheral power bus and the cathode connection portion in the first cathode contact region cC1 becomes smaller, resulting in a larger electric resistance and a larger voltage drop. The resulting voltage change may cause display unevenness in a first display area AA1, if no change is made in the design. In one embodiment of the present disclosure, the width D3 of the fourth cathode contact region cC4 in the third sub-non-display area BA23 is further set to be equal to D1, that is, to increase the voltage drop of the voltage signal transmitted in the second non-display area from the peripheral power bus to the cathode connection portion. So that the difference in voltage drop of the voltage signal transmitted from two sides of the display area to the middle of the display area in the first direction can be balanced in the cathode layer, thereby improving display uniformity.

Figure 18:
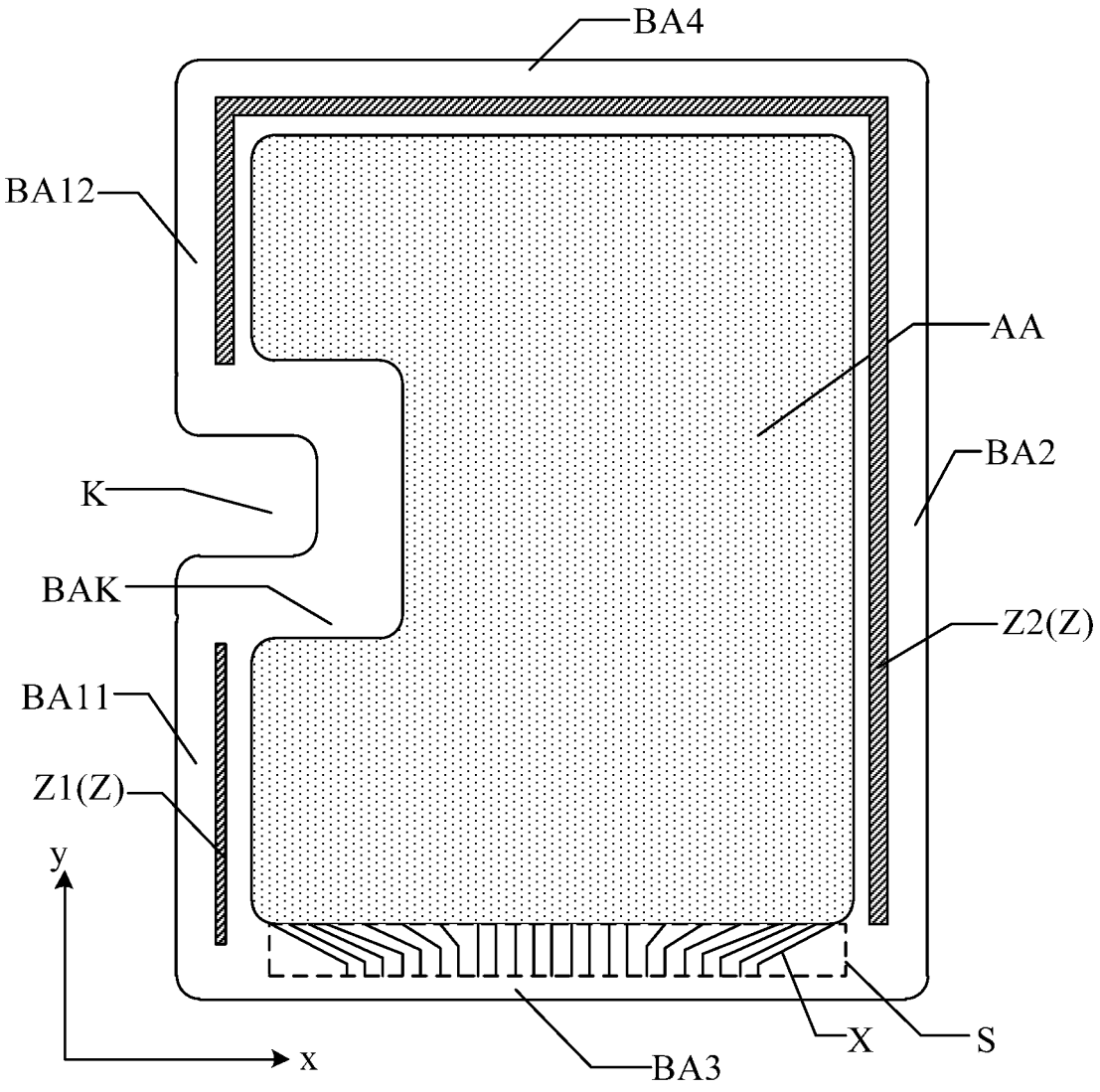
FIG. 18 is a schematic view of another alternative embodiment of the display panel according to one embodiment of the present disclosure.

In another embodiment, FIG. 18 is a schematic view of another alternative embodiment of the display panel according to one embodiment of the present disclosure. As shown in FIG. 18, the first non-display area BA1 further includes the first sub-non-display area BA11 and the second sub-non-display area BA12. In the second direction y, the first sub-non-display area BA11 and the second sub-non-display area BA12 are respectively located on both sides of the notched non-display area BAK. The first sub-non-display area BA11 is connected to the third non-display area BA3. The second sub-non-display area BA12, the fourth non-display area BA4, and the second non-display area BA2, are sequentially connected with each other. The peripheral power bus Z includes a first bus Z1 and a second bus Z2, the first bus Z1 is routed in the first sub-non-display area BA1, and the second bus Z2 is sequentially routed in the second sub-non-display area BA12, in the four non-display area BA4, and in the second non-display area BA2. At least part of the second bus Z2 has a line width larger than a line width of the first bus Z1. It should be noted that FIG. 18 only shows the positions of the first bus Z1 and the second bus Z2 in the display panel, and a scenario that the line width of the second bus Z2 located in each non-display area is greater than the line width of the first bus Z1. Optionally, in one embodiment, the cathode voltage signal line is not disposed at least in the notched non-display area BAK, so that narrowing of the notched non-display area BAK can be further achieved, and the cathode voltage signal is disconnected in the notched non-display area BAK. In case where the cathode voltage signal line is disposed in other non-display area of the display panel, the cathode voltage signal line is sequentially routed in the second sub-non-display area BA12, in the fourth non-display area BA4, and in the second non-display area, to supply a cathode voltage signal to the cathode contact region in the second sub-non-display area BA12. A cathode voltage signal is supplied to the cathode contact region in the first sub-non-display area BA11 through the cathode voltage signal line disposed in the first sub-non-display area BA11. In the case where the cathode voltage signal line is not disposed in other non-display areas of the display panel, a cathode voltage signal is supplied to the peripheral power bus in the second sub-non-display area BA12 through the peripheral power bus sequentially routed in the second sub-non-display area BA12, in the fourth non-display area BA4, and in the second non-display area. The peripheral power bus is connected to the driving chip in the first sub-non-display area BA11. Optionally, a line width of a portion of the second bus Z2 located in one of the second sub-non-display area BA12, the fourth non-display area BA4, and the second non-display area BA2 may be greater than a line width of the first bus Z1. According to the resistance calculation formula, it can be known that the line width becomes larger and the resistance becomes smaller, so that the resistance of the second bus can be reduced by adjusting a line width of at least part of the second bus, and it can reduce the voltage drop in the peripheral power bus when the driving chip transmits the voltage signal to the cathode layer. The resulting voltage drop reduction can compensate the voltage drop increase caused by the reduction in the width of the first cathode contact region in the present disclosure, and can ensure that the narrowed notched non-display area is achieved without increasing power consumption.

Further, in one embodiment in which the first cathode contact region is not disposed in the notched non-display area BAK, the peripheral power bus is not disposed in the notched non-display area, the second bus is sequentially rounted in the second non-display area, in the fourth non-display area, and in the second sub-non-display area, and the voltage drop is larger in the second bus. Setting a line width of at least a part of the second bus to be larger than the line width of the first bus, to reduce the resistance of the second bus, thereby reducing the voltage drop across the second bus, and balancing the voltage drop difference between the first bus and the second bus.

Figure 19:
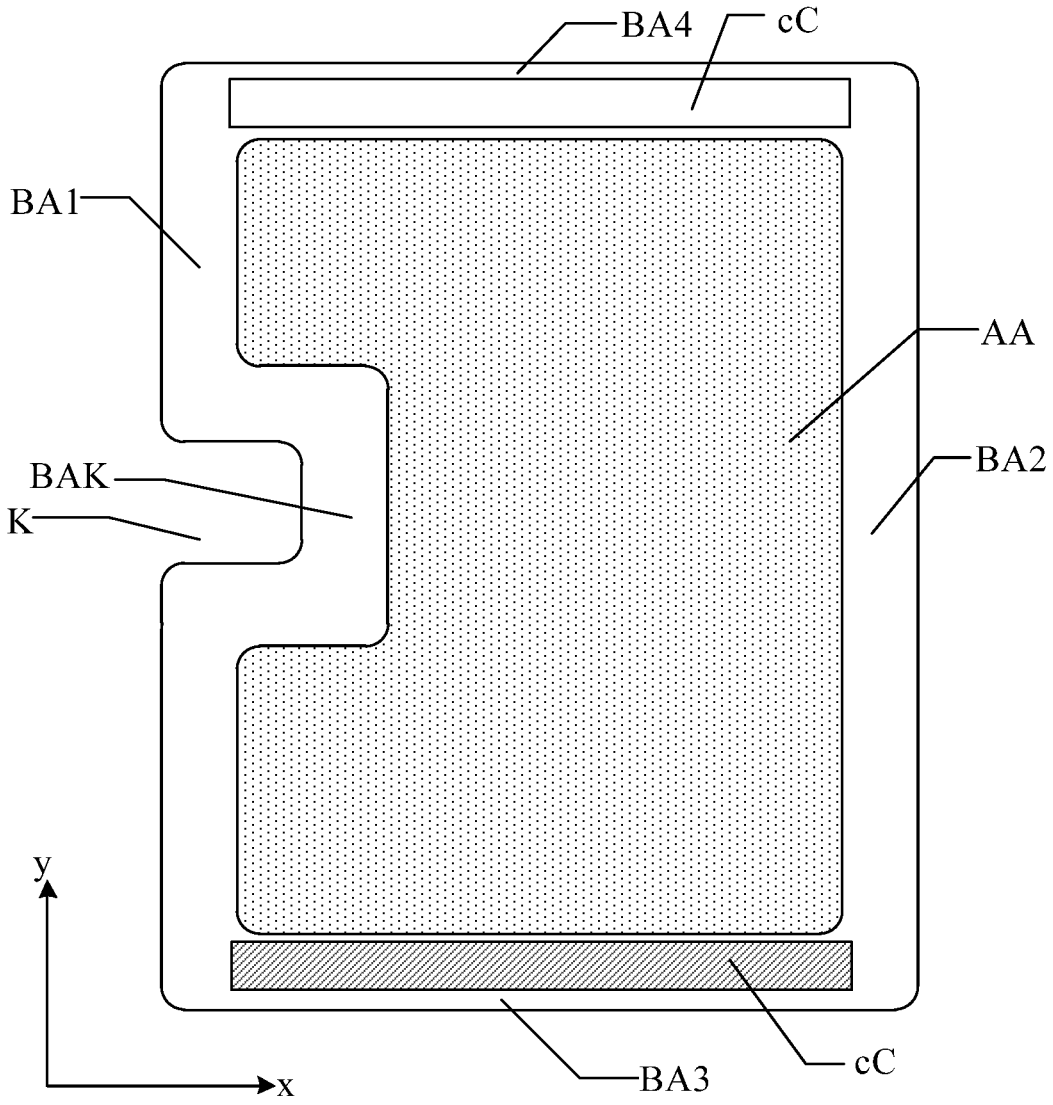
FIG. 19 is a schematic view of another alternative embodiment of the display panel according to one embodiment of the present disclosure.

In one embodiment, FIG. 19 is a schematic view of another alternative embodiment of the display panel according to one embodiment of the present disclosure. As shown in FIG. 19, the cathode contact region cC is not disposed in the first non-display area BA1 and the second non-display area BA2, that is, the cathode contact region cC is provided only in the third non-display area BA3 and the fourth non-display area BA4 as illustrated in the figure. In one embodiment, the spaces of the first non-display area and the second non-display area can be reduced to narrow the first non-display area and the second non-display area.

Figure 20:
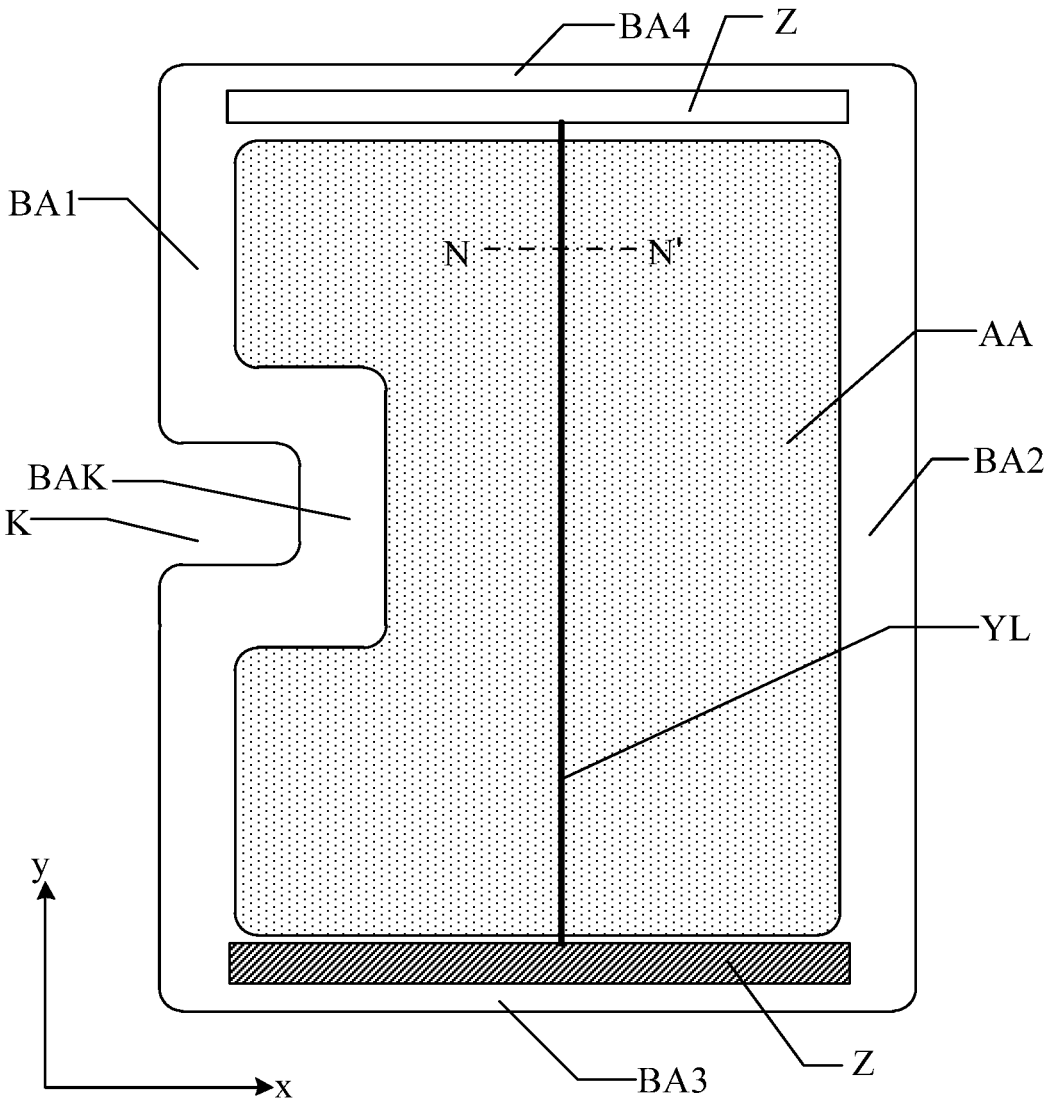
FIG. 20 is a schematic view of another alternative embodiment of the display panel according to one embodiment of the present disclosure.

Further, FIG. 20 is a schematic view of another alternative embodiment of the display panel according to one embodiment of the present disclosure. As shown in FIG. 20, the display panel further includes at least one power connection line YL, and only one power connection line YL is illustrated. The at least one power connection line YL is located in the display area AA. One end of the at least one power connection line YL is electrically connected to the peripheral power bus Z in the fourth non-display area BA4, and another end of the at least one power connection line YL is electrically connected to the peripheral power bus Z in the third non-display area BA3. Taking one embodiment corresponding to FIG. 19 as an example, the at least one power connection line YL is respectively connected to the peripheral power bus Z located in the fourth non-display area BA4 and the third non-display area BA3, and the at least one power connection line YL can pass the voltage signal into the cathode layer of the display region through the cathode contact region of the fourth non-display area, which is equivalent to increasing the contact area with the cathode layer in the voltage signal transmission direction, which is advantageous for reducing voltage drop and thereby reducing power consumption. The at least one power connection line illustrated in FIG. 20 can be disposed in any of the display panels provided in any of the above embodiments.

In another optional embodiment, the cathode contact region may be disposed only in the third non-display area, and the cathode contact region is not disposed in the first non-display area, the second non-display area, and the fourth non-display area.

Figure 21:
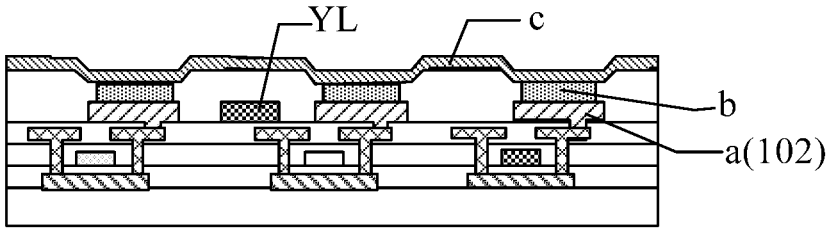
FIG. 21 is a cross-sectional view showing an alternative embodiment of the tangential line N-N' in FIG. 20.

FIG. 21 is a schematic cross-sectional view of an alternative embodiment of the tangential line N-N' of FIG. 20. As shown in FIG. 21, the display panel includes the light emitting device layer 102. The light emitting device layer 102 includes the plurality of anodes a insulated from each other, and further includes the light emitting layer b. The at least one power connection line YL is located in a same film layer as the plurality of anodes a and is insulated from the plurality of anodes a. The at least one power connection line YL is routed between adjacent two anodes a. Actually, the at least one power connection line YL is adjusted according to the arrangement of the plurality of anodes in the display panel. The at least one power connection line YL may be one of a straight line and a bending line. The at least one power connection line is located on the same film layer as the plurality of anodes, no new process is added during production, and it is simple to manufacture.

Figure 22:
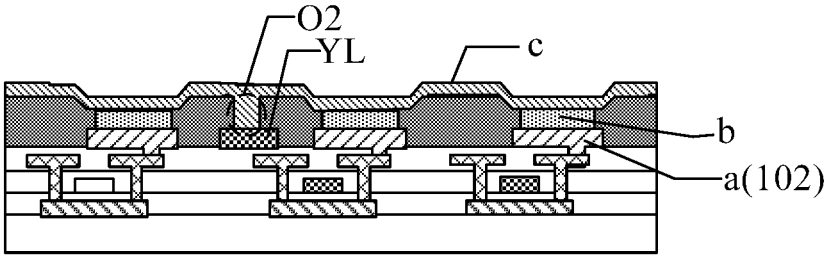
FIG. 22 is a cross-sectional view showing another alternative embodiment of the tangent line N-N' in FIG. 20.

FIG. 22 is a cross-sectional view showing another alternative embodiment of the tangent line N-N' in FIG. 20. As shown in FIG. 22, the display panel further includes a pixel defining layer 101 having second openings O2, and the at least one power connection line YL is electrically connected to the cathode layer c through the second openings O2. Optionally, the at least one power connection line can be connected to the cathode layer c through a plurality of second openings. In one embodiment, the at least one power connection line is connected to the cathode layer through openings, and the at least one power connection line can also supply a voltage signal to the cathode layer, which is equivalent to increasing the contact area with the cathode layer in the voltage signal transmission direction, thereby reducing the overall resistance of the cathode layer, which reduces power consumption. A manufacturing process of the display layer at the time of display panel fabrication further includes fabrication of at least one of a hole injection layer (HIL), a hole transport layer (HTL), an electron transport layer (ETL), and an electron injection layer (EIL). The above film layers are a semiconductor material, which is usually fabricated by an evaporation process. In the present disclosure, in order to electrically connect the at least one power connection line YL to the cathode layer c, optionally, a film layer may be evaporated and a film material evaporated into the second openings O2 is electrically conductively processed. Alternatively, when the film layer is evaporated, a mask corresponding to the second openings position may be used to shield the corresponding area, thereby avoiding the film material to be evaporated into the second openings.

Figure 23:
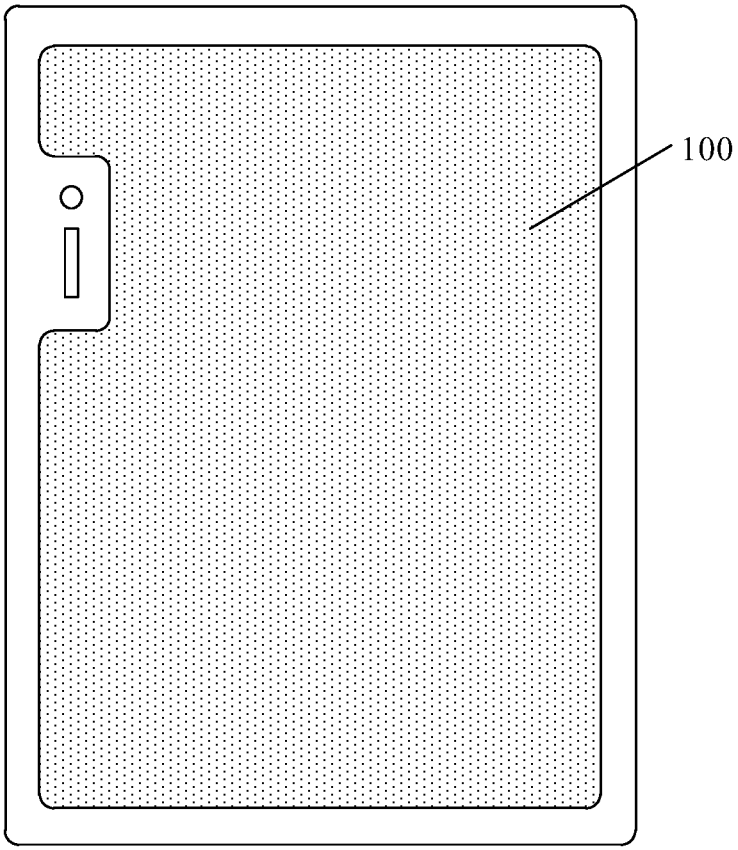
FIG. 23 is a schematic diagram of a display device according to one embodiment of the present disclosure.

The present disclosure also provides a display device. FIG. 23 is a schematic view of a display device according to one embodiment of the present disclosure. As shown in FIG. 23, the display device includes a display panel 100 according to any embodiment of the present disclosure.

It can be seen from the above embodiments that the display panel and the display device provided by the present disclosure achieve at least the following beneficial effects.

In the display panel provided by the present disclosure, the width D1 of the first cathode contact region is smaller than the width D2 of the second cathode contact region, which can reduce the space occupied by the cathode contact region in the notched non-display area, which is beneficial to narrow the notched non-display area.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the preferred embodiments of the present disclosure, it is understood that it will be appreciated by those skilled in the art that the above embodiments may be modified without departing from the scope and spirit of the present disclosure. The scope of the present disclosure is defined by the appended claims.

What is claimed is:

1. A display panel, comprising:

a display area, a non-display area surrounding the display area, and at least one notch, wherein an edge of the display panel is recessed toward an inside of the display area in a first direction to form the at least one notch; the non-display area includes a first non-display area, a second non-display area, a third non-display area, and a fourth non-display area; in the first direction, the first non-display area and the second non-display area are oppositely disposed; in a second direction, the third non-display area and the fourth non-display area are oppositely disposed; the second direction intersects with the first direction; the first non-display area includes a notched non-display area, and the notched non-display area partially surrounds the at least one notch; and the third non-display area includes a fan-out area for setting signal lines to connect a driving chip to the display area;

a cathode layer, extending from the display area to the non-display area, and including a cathode connection portion located in the non-display area;

a peripheral power bus, located in the non-display area, wherein the non-display area includes a cathode contact region, the peripheral power bus is connected to the cathode connection portion in the cathode contact region; the cathode contact region includes a first cathode contact region and a second cathode contact region; the first cathode contact region is located in the notched non-display area; and the second cathode contact region is located in the fourth non-display area; and shift registers, located in the non-display area, wherein the shift registers include first shift registers, the first shift registers are located in the notched non-display area, and overlap with the first cathode contact region, in a direction perpendicular to the display panel; and in the first direction, a width of the first cathode contact region is D1, and in the second direction, a width of the second cathode contact region is D2, wherein D1<D2.

2. The display panel according to claim 1, further comprising:

a pixel defining layer and a light emitting device layer, wherein the light emitting device layer is located on a side of the pixel defining layer adjacent to a light exiting surface of the display panel;

the pixel defining layer has a plurality of first openings, and in the cathode contact region, the cathode connection portion is electrically connected to the peripheral power bus through the plurality of first openings; and the light emitting device layer includes a plurality of anodes insulated from each other and located in a same film layer as the peripheral power bus.

3. The display panel according to claim 1, wherein:

the peripheral power bus in the first cathode contact region has a concave-convex structure, and the concave-convex structure is in contact with the cathode connection portion.

4. The display panel according to claim 1, wherein:

the first non-display area further includes a first sub-non-display area and a second sub-non-display area, and in the second direction, the first sub-non-display area and the second sub-non-display area are respectively located on both sides of the notched non-display area, and the cathode contact region further includes a third cathode contact region, and the first sub-non-display region and the second sub-non-display region each includes the third cathode contact region, wherein, in the first direction, the third cathode contact region has a width D3, wherein D1<D3.

5. The display panel according to claim 4, wherein:

the shift registers further include second shift registers, and the second shift registers are disposed in each of the first sub-non-display area and the second sub-non-display area; and in the first direction, a width of the first shift registers is less than a width of the second shift registers.

6. The display panel according to claim 1, wherein:

the display panel further includes a pixel defining layer and a light emitting device layer, wherein:

the light emitting device layer is located on a side of the pixel defining layer adjacent to a light exiting surface of the display panel, the pixel defining layer has a plurality of first openings, and in the cathode contact region, the cathode connection region is electrically connected to the peripheral power bus through the plurality of first openings; and a density of the plurality of first openings in the first cathode contact region is greater than a density of the plurality of first openings in the second cathode contact region.

7. The display panel according to claim 1, wherein:

in a direction perpendicular to the display panel, a thickness of the peripheral power bus in the first cathode contact region is d1, and a thickness of the peripheral power bus in the second cathode contact region is d2, and d1<d2.

8. The display panel according to claim 1, wherein:

D1=0.

9. The display panel according to claim 1, wherein:

the display area further includes a plurality of data lines extending in the second direction, the plurality of data lines includes first data lines, and the first data lines are intercepted by the at least one notch;

the display panel further includes connecting lines, and the connecting lines are located in the notched non-display area; and two of the first data lines located on both sides of the at least one notch and located in a same column are connected by the connecting lines.

10. The display panel according to claim 9, wherein:

the connecting lines are located at a side of the first shift registers adjacent to the display area; and in the first direction, a total width of all the connecting lines is D4;

the first non-display area includes a first sub-non-display area and a second sub-non-display area that are respectively located on both sides of the notched non-display area along the second direction;

the shift registers further includes second shift registers, the second shift registers are disposed in each of the first sub-non-display area and the second sub-non-display area, and in the first direction, a width of the first shift registers is D5, and a width of the second shift registers is D6; and $$D4+D5<D6.$$

11. The display panel according to claim 1, wherein:

the second non-display area further includes a third sub-non-display area, the cathode contact region includes a fourth cathode contact region, and the fourth cathode contact region is located in the third sub-non-display area; and in the first direction, a width of the fourth cathode contact region is D3, wherein D3=D1.

12. The display panel according to claim 11, wherein:

in the second direction, a length of the fourth cathode contact region is equal to a length of the first cathode contact region; and in the first direction, the third sub-non-display region and the notched non-display area are disposed oppositely to each other.

13. The display panel according to claim 1, wherein:

the first non-display area further includes a first sub-non-display area and a second sub-non-display area; in the second direction, the first sub-non-display area and the second sub-non-display area are respectively located on both sides of the notched non-display area; the first sub-non-display area is connected with the third non-display area; and the second sub-non-display area, the fourth non-display area, and the second non-display area are sequentially connected with each other; and the peripheral power bus includes a first bus and a second bus; the first bus is routed in the first sub-non-display area; the second bus is sequentially routed in the second sub-non-display area, the fourth non-display area, and the second non-display area; and at least a portion of the second bus has a line width greater than a line width of the first bus.

14. The display panel according to claim 1, wherein:

the cathode contact region is not disposed in both the first non-display area and the second non-display area.

15. The display panel according to claim 1, further comprising:

at least one power connection line located in the display area, wherein one end of the at least one power connection line is electrically connected to the peripheral power bus located in the fourth non-display area, and another end of the at least one power connection line is electrically connected to the peripheral power bus located in the third non-display area.

16. The display panel according to claim 15, further comprising:

a light emitting device layer, including a plurality of anodes insulated from each other, wherein the at least one power connection line is located in a same film layer as the plurality of anodes and is insulated from the plurality of anodes.

17. The display panel according to claim 16, further comprising:

a pixel defining layer has second openings, wherein the at least one power connection line is electrically connected to the cathode layer through the second openings.

18. The display panel according to claim 14, further comprising:

at least one power connection line located in the display area, wherein one end of the at least one power connection line is electrically connected to the peripheral power bus located in the fourth non-display area, and another end of the at least one power connection line is electrically connected to the peripheral power bus located in the third non-display area.

19. A display device, comprising:

a display panel, comprising:

a display area, a non-display area surrounding the display area, and at least one notch, wherein an edge of the display panel is recessed toward an inside of the display area in a first direction to form the at least one notch; the non-display area includes a first non-display area, a second non-display area, a third non-display area, and a fourth non-display area; in the first direction, the first non-display area and the second non-display area are oppositely disposed; in a second direction, the third non-display area and the fourth non-display area are oppositely disposed; the second direction intersects with the first direction; the first non-display area includes a notched non-display area, and the notched non-display area partially surrounds the at least one notch; and the third non-display area includes a fan-out area for setting signal lines to connect a driving chip to the display area;

a cathode layer, extending from the display area to the non-display area, and including a cathode connection portion located in the non-display area;

a peripheral power bus, located in the non-display area, wherein the non-display area includes a cathode contact region, the peripheral power bus is connected to the cathode connection portion in the cathode contact region; the cathode contact region includes a first cathode contact region and a second cathode contact region; the first cathode contact region is located in the notched non-display area; and the second cathode contact region is located in the fourth non-display area; and shift registers, located in the non-display area, wherein the shift registers include first shift registers, the first shift registers are located in the notched non-display area, and overlap with the first cathode contact region, in a direction perpendicular to the display panel; and in the first direction, a width of the first cathode contact region is D1, and in the second direction, a width of the second cathode contact region is D2, wherein D1<D2.

* * * * *